US012366394B2

(12) United States Patent
Wei et al.

(10) Patent No.: US 12,366,394 B2
(45) Date of Patent: Jul. 22, 2025

(54) AUTOMATIC REFRIGERANT CHARGING SYSTEM AND METHOD FOR AIR CONDITIONERS

(71) Applicant: Yiso (Guangdong) Smart Technology Co.,Ltd, Foshan (CN)

(72) Inventors: Fudang Wei, Foshan (CN); Zhicheng Huang, Foshan (CN); Ceyun Tang, Foshan (CN)

(73) Assignee: Yiso (Guangdong) Smart Technology Co.,Ltd, Foshan (CN)

( * ) Notice: Subject to any disclaimer, the term of this patent is extended or adjusted under 35 U.S.C. 154(b) by 0 days.

(21) Appl. No.: 18/955,726

(22) Filed: Nov. 21, 2024

(65) Prior Publication Data

US 2025/0075954 A1 Mar. 6, 2025

(30) Foreign Application Priority Data

Apr. 11, 2024 (CN) ..... 202410436068.8

(51) Int. Cl.
*F25B 45/00* (2006.01)

(52) U.S. Cl.
CPC ..... *F25B 45/00* (2013.01); *F25B 2313/031* (2013.01); *F25B 2345/003* (2013.01); *F25B 2500/19* (2013.01)

(58) Field of Classification Search
CPC ..... F25B 2500/19; F25B 2345/003; F25B 2313/031; F25B 45/00
See application file for complete search history.

(56) References Cited

U.S. PATENT DOCUMENTS

2011/0088414 A1 4/2011 Yamaguchi et al.

FOREIGN PATENT DOCUMENTS

| | | | | |
|---|---|---|---|---|
| CN | 104534752 A | * | 4/2015 | ..... F25B 45/00 |
| CN | 107726534 A | | 2/2018 | |
| CN | 113465240 A | | 10/2021 | |
| CN | 114017891 A | | 2/2022 | |
| EP | 3324137 A1 | | 5/2018 | |

* cited by examiner

*Primary Examiner* — Ana M Vazquez

(57) ABSTRACT

An automatic refrigerant charging system, including a charging device, a to-be-charged air conditioner, and a refrigerant storage tank connected to the air conditioner through the charging device. The refrigerant storage tank is configured for storing the refrigerant. The charging device is configured for controlling the refrigerant charge into the air conditioner. The charging device includes a detection member, a charging member and a control member. The detection member and the charging member are installed in the air conditioner, and electrically connected to the control member. The detection member is configured for detecting operation parameters of the air conditioner in real time. The charging member is configured for charging the air conditioner with the refrigerant. The control member is configured for controlling a charging action of the charging member.

4 Claims, 2 Drawing Sheets

AUTOMATIC REFRIGERANT CHARGING SYSTEM AND METHOD FOR AIR CONDITIONERS

CROSS-REFERENCE TO RELATED APPLICATIONS

This application claims the benefit of priority from Chinese Patent Application No. 202410436068.8, filed on Apr. 11, 2024. The content of the aforementioned application, including any intervening amendments thereto, is incorporated herein by reference in its entirety.

TECHNICAL FIELD

This application relates to refrigerant charging in air conditioners, and more particularly to an automatic refrigerant charging system and method for air conditioners.

BACKGROUND

A unitary air conditioner or heat pump, which refers to split and package units, is made up of several units. The unitary air conditioner works mainly through the refrigerant circulation and consists of an indoor unit and an outdoor unit. The indoor unit is used for absorbing heat, and the outdoor unit is used for discharging heat. The refrigerant circulates between the indoor unit and the outdoor unit, absorbing and releasing heat through compression and expansion to achieve the cooling or warming effect.

Refrigerant is an important medium for transferring heat in the air-conditioner system. Refrigerant, also known as cold media, is used to exchange heat efficiently so that the air conditioner cools or heats. The air-conditioner needs to have enough refrigerant when in normal use.

In the installation of unitary air conditioners, there are two situations where the additional refrigerant is required, for example, some products require additional refrigerant due to the long connecting pipe with the outdoor unit, or some products need to be repaired due to the occurrence of slight leakage during operation, and the refrigerant needs to be properly added and supplemented after repairing the pipeline. As the amount of the added refrigerant needs to be confirmed by the maintenance engineers on site, especially the refrigerant replenishment during the maintenance process, in order to ensure that the air conditioner operates in a better state, the maintenance engineer needs to have a strong technical experience and a detailed understanding of the parameters of the air conditioner, which not only greatly increases the technical difficulty, but also results in cumbersome operation and the presence of manual error.

For the existing automatic refrigerant charging control device of unitary air conditioners, because the communication control is necessary between the indoor and outdoor units, the automatic charging control device must be developed and installed to be coordinated with the indoor and outdoor units. Moreover, the automatic charging control device is only used for refrigeration, which has the problems of high production cost and single control mode.

SUMMARY

An object of this application is to provide an automatic refrigerant charging system, which can achieve the automatic, accurate, efficient and safe refrigerant charging for air conditioners.

Another object of this application is to provide an automatic refrigerant charging method using the such automatic refrigerant charging system, through which the refrigerant charging process can be intelligently and automatically adjusted according to the operation mode of the air-conditioning system and the environmental conditions.

Technical solutions of this application are described as follows.

This application provides an automatic refrigerant charging system, comprising:

a charging device;

a to-be-charged air conditioner; and a refrigerant storage tank;

wherein the to-be-charged air conditioner is connected to the refrigerant storage tank through the charging device; the refrigerant storage tank is configured for storing a refrigerant; and the charging device is configured for controlling an amount of the refrigerant charged into the to-be-charged air conditioner;

the charging device comprises a detection member, a charging member and a control member;

the detection member and the charging member are both installed in the to-be-charged air conditioner; and the detection member and the charging member are electrically connected to the control member;

the detection member is configured for detecting operation parameters of the to-be-charged air conditioner in real time;

the charging member is configured for charging the to-be-charged air conditioner with the refrigerant; and the control member is configured for controlling a charging action of the charging member according to the operation parameters and an operating mode of the to-be-charged air conditioner.

In an embodiment, the to-be-charged air conditioner comprises an indoor unit and an outdoor unit; the indoor unit is connected to the outdoor unit; and the charging device is connected to the outdoor unit.

In an embodiment, the indoor unit comprises an evaporator; and the evaporator is provided with a liquid inlet end and a liquid outlet end;

the outdoor unit comprises a compressor, a gas-liquid separator, a condenser, a four-way valve, and a throttling member;

the compressor is provided with an air discharge end and an air return end; the gas-liquid separator is provided with an inlet end and an outlet end; the condenser is provided with an input end and an output end; and the four-way valve is provided with a first connection port, a second connection port, a third connection port and a fourth connection port; and the air discharge end of the compressor is connected to the first connection port of the four-way valve, and the air return end of the compressor is connected to the outlet end of the gas-liquid separator; the inlet end of the gas-liquid separator is connected to the charging member and the second connection port of the four-way valve, respectively; the third connection port of the four-way valve is connected to the liquid outlet end of the evaporator; the fourth connection port of the four-way valve is connected to the input end of the condenser; and the output end of the condenser is connected to the liquid inlet end of the evaporator through the throttling member.

In an embodiment, the detection member comprises a first pressure sensor, a second pressure sensor, a first temperature sensor, a second temperature sensor, a third temperature sensor, a fourth temperature sensor, and a fifth temperature sensor;

the first pressure sensor is configured to obtain a first refrigerant pressure HP, and the second pressure sensor is configured to obtain a second refrigerant pressure LP; wherein the first refrigerant pressure HP is higher than the second refrigerant pressure LP;

the first temperature sensor is configured to obtain a refrigerant temperature Th of the condenser;

the second temperature sensor is configured to obtain an outlet temperature Tl of the condenser;

the third temperature sensor is configured to obtain a return air temperature Ts of the compressor;

the fourth temperature sensor is configured to obtain a discharge air temperature Td of the compressor; and the fifth temperature sensor is configured for obtain an ambient temperature Ta.

In an embodiment, the charging member comprises a charging pipeline and a charging valve; and a first end of the charging pipeline is connected to the outdoor unit, and a second end of the charging pipeline is connected to the refrigerant storage tank; and the charging pipeline is provided with the charging valve.

In an embodiment, the control member is configured to perform steps (S11)-(S13) in response to a case that the outdoor unit receives a switch-on command:

(S11) obtaining the first refrigerant pressure HP from the first pressure sensor; obtaining a first refrigerant saturation temperature Tc based on the first refrigerant pressure HP; and obtaining the refrigerant temperature Th from the first temperature sensor;

(S12) when |Th−Tc|> a preset refrigerant temperature value a, controlling the charging valve to open for X seconds to charge the refrigerant, and controlling the charging valve to close, and repeating steps (S11) to (S12); and (S13) when |Th−Tc|≤ the preset refrigerant temperature value a, starting the outdoor unit;

the control member is also configured to perform steps (S21)-(S27) in response to a case that the to-be-charged air conditioner is set to operate in a cooling mode:

(S21) obtaining the first refrigerant pressure HP from the first pressure sensor; obtaining the second refrigerant pressure LP from the second pressure sensor; obtaining the refrigerant temperature Th from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S22) obtaining the first refrigerant saturation temperature Tc based on the first refrigerant pressure HP; and obtaining a second refrigerant saturation temperature Te based on the second refrigerant pressure LP;

(S23) calculating a suction superheat SSH of the compressor by formula (1), expressed as:

$$SSH = Ts - Te; \tag{1}$$

(S24) calculating a subcooling degree SC of the condenser by formula (2), expressed as:

$$SC = Tc - Tl + b; \tag{2}$$

wherein b denotes a first correction value;

(S25) when the suction superheat SSH of the compressor>a first preset suction superheat value c of the compressor, and the subcooling degree SC<a preset subcooling value d of the condenser, calculating a refrigerant coefficient η by formula (3), expressed as:

$$\eta = SC/(Tc - Ta); \tag{3}$$

(S26) according to a first preset refrigerant coefficient value and a second preset refrigerant coefficient value, controlling the charging valve to charge the refrigerant:

(S261) when the refrigerant coefficient η is less than the first preset refrigerant coefficient value e, controlling the charging valve to open for Y1 seconds for refrigerant charging; and (S262) when the refrigerant coefficient η is less than the second preset refrigerant coefficient value f, controlling the charging valve to open for Z1 seconds for refrigerant charging; wherein the first preset refrigerant coefficient value e is larger than the second preset refrigerant coefficient value f; and (S27) repeating steps (S21) to (S26); and when the refrigerant coefficient η does not satisfy conditions in step (S26) (namely, the refrigerant coefficient η is equal to or larger than the first preset refrigerant coefficient value e), completing refrigerant charging in the cooling mode; and the control member is also configured to perform steps (S31)-(S37) in response to a case that the to-be-charged air conditioner is set to operate in a heating mode;

(S31) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S32) obtaining the first refrigerant saturation temperature Tc based on the first refrigerant pressure HP; and obtaining the second refrigerant saturation temperature Te based on the second refrigerant pressure LP;

(S33) calculating the suction superheat SSH of the compressor by the formula (1);

(S34) calculating a discharge superheat DSH of the compressor by formula (4), expressed as:

$$DSH = Td - Tc; \tag{4}$$

(S35) when the suction superheat SSH>a second preset suction superheat value h of the compressor, and the discharge superheat DSH>a preset discharge superheat value i of the compressor, calculating the subcooling degree SC of the condenser by formula (5), expressed as:

$$SC = Tc - Tl + g; \quad (5)$$

wherein g denotes a second correction value;

(S36) according to a first preset subcooling degree value and a second preset subcooling degree value of the condenser, controlling the charging valve to charge the refrigerant:

(S361) when the subcooling degree SC is less than the first preset subcooling degree value j, controlling the charging valve to open for Y2 seconds for refrigerant charging; and (S362) when the subcooling degree SC is less than the second preset subcooling degree value k, controlling the charging valve to open for Z2 seconds for refrigerant charging; wherein the first preset subcooling degree value j is greater than the second preset subcooling degree value k; and (S37) repeating steps (S31) to (S36), and when the subcooling degree SC does not satisfy conditions in step (S36), completing the refrigerant charging in the heating mode.

This application further provides an automatic refrigerant charging method using the automatic refrigerant charging system above, comprising:

(A) installing the to-be-charged air conditioner, and connecting the charging device to the outdoor unit;

(B) setting an operation mode of the to-be-charged air conditioner and an automatic refrigerant charging operation corresponding thereto, wherein the operation mode comprises the cooling mode and the heating mode;

(C) when the outdoor unit of the to-be-charged air conditioner receives the switch-on command, based on real-time detection results of operation parameters of the outdoor unit obtained by the detection member, determining, by the control member, whether a start-up condition for the refrigerant charging is satisfied, if not, controlling the charging member to carry out a part of the refrigerant charging to reach the start-up condition; and (D) when the outdoor unit works for a certain period, setting the operation mode; according to the operation mode and the operation parameters of the outdoor unit detected in real time by the detection member, determining repeatedly, by the control member, whether the outdoor unit is required to carry out the refrigerant charging.

In an embodiment, the step (C) comprises:

(S11) obtaining the first refrigerant pressure HP from the first pressure sensor; obtaining the first refrigerant saturation temperature Tc based on the first refrigerant pressure HP; and obtaining the refrigerant temperature Th from the first temperature sensor;

(S12) when $|Th-Tc| >$ the preset refrigerant temperature value a, controlling the charging valve to open for X seconds to charge the refrigerant, and controlling the charging valve to close, and repeating steps (S11) to (S12);

(S13) when $|Th-Tc| \leq$ the preset refrigerant temperature value a, starting the outdoor unit.

In an embodiment, step (D) comprises:

the control member is also configured to perform steps (S21)-(S27) in response to the case that the to-be-charged air conditioner is set to operate in the cooling mode:

(S21) obtaining the first refrigerant pressure HP from the first pressure sensor; obtaining the second refrigerant pressure LP from the second pressure sensor; obtaining the refrigerant temperature Th from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S22) obtaining the first refrigerant saturation temperature Tc based on the first refrigerant pressure HP; and obtaining the second refrigerant saturation temperature Te based on the second refrigerant pressure LP;

(S23) calculating the suction superheat SSH of the compressor by formula (1), expressed as:

$$SSH = Ts - Te; \quad (1)$$

(S24) calculating the subcooling degree SC of the condenser by formula (2), expressed as:

$$SC = Tc - Tl + b; \quad (2)$$

wherein b denotes the first correction value;

(S25) when the suction superheat SSH of the compressor>the first preset suction superheat value c of the compressor, and the subcooling degree SC<the preset subcooling value d of the condenser, calculating the refrigerant coefficient η by formula (3), expressed as:

$$\eta = SC/(Tc - Ta); \quad (3)$$

(S26) according to the first preset refrigerant coefficient value and the second preset refrigerant coefficient value, controlling the charging valve to charge the refrigerant:

(S261) when the refrigerant coefficient η is less than the first preset refrigerant coefficient value e, controlling the charging valve to open for Y1 seconds for refrigerant charging; and (S262) when the refrigerant coefficient η is less than the second preset refrigerant coefficient value f, controlling the charging valve to open for Z1 seconds for refrigerant charging; wherein the first preset refrigerant coefficient value e is larger than the second preset refrigerant coefficient value f; and (S27) repeating steps (S21) to (S26); and when the refrigerant coefficient η does not satisfy conditions in step (S26) (namely, the refrigerant coefficient η is equal to or larger than the first preset refrigerant coefficient value e), completing refrigerant charging in the cooling mode; and the control member is also configured to perform steps (S31)-(S37) in response to the case that the to-be-charged air conditioner is set to operate in the heating mode;

(S31) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S32) obtaining the first refrigerant saturation temperature Tc based on the first refrigerant pressure HP; and obtaining the second refrigerant saturation temperature Te based on the second refrigerant pressure LP;

(S33) calculating the suction superheat SSH of the compressor by the formula (1);

(S34) calculating the discharge superheat DSH of the compressor by formula (4), expressed as:

$$DSH = Td - Tc; \tag{4}$$

(S35) when the suction superheat SSH>the second preset suction superheat value h of the compressor, and the discharge superheat DSH>the preset discharge superheat value i of the compressor, calculating the subcooling degree SC of the condenser by formula (5), expressed as:

$$SC = Tc - Tl + g; \tag{5}$$

wherein g denotes the second correction value;

(S36) according to the first preset subcooling degree value and the second preset subcooling degree value of the condenser, controlling the charging valve to charge the refrigerant:

(S361) when the subcooling degree SC is less than the first preset subcooling degree value j, controlling the charging valve to open for Y2 seconds for refrigerant charging; and (S362) when the subcooling degree SC is less than the second preset subcooling degree value k, controlling the charging valve to open for Z2 seconds for refrigerant charging; wherein the first preset subcooling degree value j is greater than the second preset subcooling degree value k; and (S37) repeating steps (S31) to (S36), and when the subcooling degree SC does not satisfy conditions in step (S36), completing the refrigerant charging in the heating mode.

Compared to the prior art, this application has the following beneficial effects.

This application not only greatly realizes the air-conditioning system to automatically adjust refrigerant charging under installation and maintenance conditions, but also greatly improve the feasibility of on-site operation, reduce the technical difficulty of on-site operation, and greatly alleviate the workload of on-site operation. This application can also greatly improve the accuracy and efficiency of refrigerant charging, reduce the error and complexity of manual operation, reduce the labor cost, improve the working efficiency and save the cost for the enterprise. Moreover, the automatic refrigerant charging system has the effect of intelligent monitoring and automatic adjustment, which can monitor the relevant operation parameters of the to-be-charged air conditioner in real time, and detect the problems in time and carry out refrigerant charging in the cooling mode or the heating mode, which can be adapted to the different modes, and ensure the normal operation and high-efficiency performance of the to-be-charged air conditioner.

100, charging device; 110, detection member; 120, charging member; 121, charging pipeline; 122, charging valve; 130, control member; 200, to-be-charged air conditioner; 210, indoor unit; 211, evaporator; 220, outdoor unit; 221, compressor; 222, gas-liquid separator; 223, condenser; 224, four-way valve; 225, throttling member; and 300, refrigerant storage tank.

DETAILED DESCRIPTION OF EMBODIMENTS

The technical solutions of the present disclosure will be further described below in conjunction with the accompanying drawings and embodiments.

Figure 1:
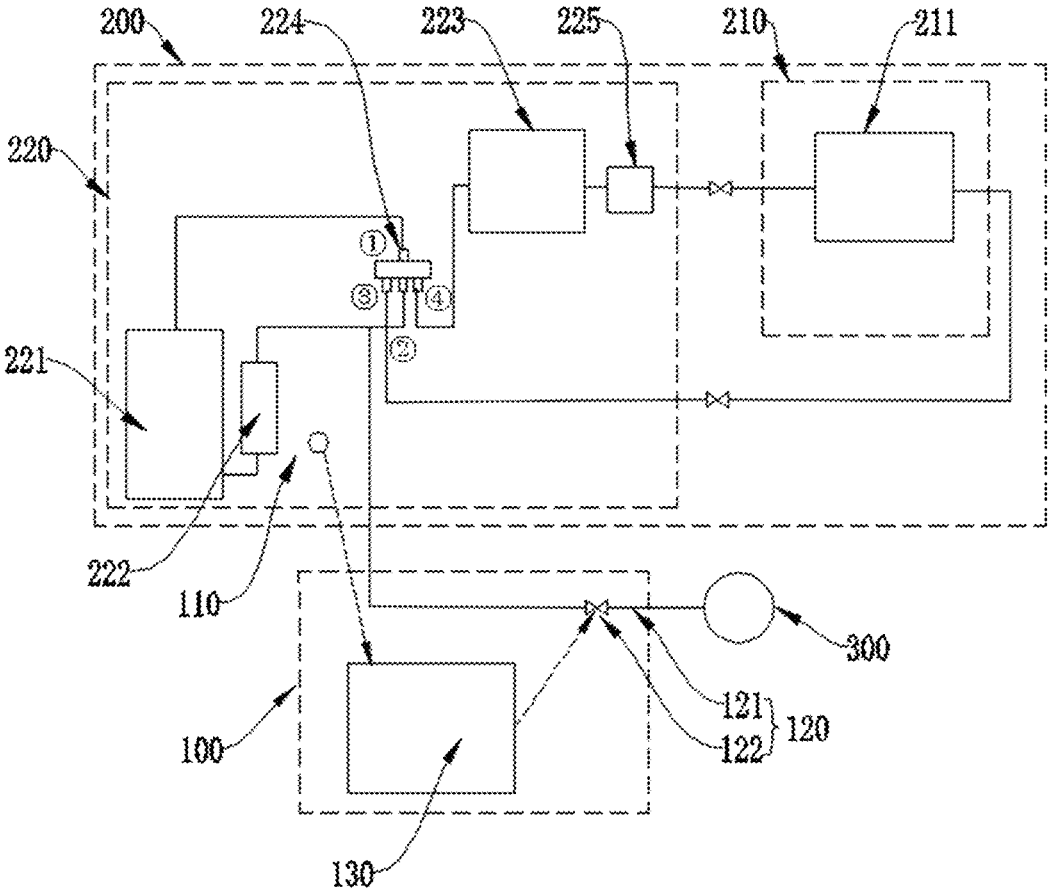
FIG. 1 schematically shows a structure of an automatic refrigerant charging system according to one embodiment of the present disclosure.

As shown in FIG. 1, an automatic refrigerant charging system includes a charging device 100, a to-be-charged air conditioner 200 and a refrigerant storage tank 300. The to-be-charged air conditioner 200 is connected to the refrigerant storage tank 300 through the charging device 100. The refrigerant storage tank 300 is used to store the refrigerant. The charging device 100 is used to control the amount of refrigerant charged into the to-be-charged air conditioner 200.

The charging device 100 includes a detection member 110, a charging member 120 and a control member 130.

The detection member 110 and charging member 120 are installed in the to-be-charged air conditioner 200. The detection member 110 and the charging member 120 are electrically connected to the control member 130.

The detection member 110 is used to detect the relevant operation parameters of the to-be-charged air conditioner 200 in real time.

The charging member 120 is used for charging the refrigerant to the to-be-charged air conditioner 200.

The control member 130 is used for controlling the charging action of the charging member 120 according to the relevant operation parameters and operating mode of the to-be-charged air conditioner 200.

The working principle of the automatic refrigerant charging system is as follows. Firstly, the detection member 110 will detect the relevant operation parameters in the to-be-charged air conditioner 200, such as refrigerant pressure and ambient temperature, which will be fed back to the control member 130 to determine whether refrigerant charging is required. Once it is determined that the refrigerant charging is required, the control member 130 will automatically open the charging member 120 to charge an appropriate amount of refrigerant into the to-be-charged air conditioner 200. After charging, the detection member 110 may also monitor the relevant operation parameters of the to-be-charged air conditioner 200 in real time to ensure that the refrigerant not be excessive or insufficient. At the same time, the system will also control the charging action according to a plurality of preset values to achieve the best charging effect.

In summary, the automatic refrigerant charging system provided in this disclosure not only greatly enhances the air-conditioning system to achieve automatic refrigerant charging adjustment in the installation and maintenance conditions, but also greatly improves the feasibility of on-site operation, reduces the technical difficulty of on-site operation, and greatly reduces the technical workload of on-site operation. This application can also greatly improve the accuracy and efficiency of refrigerant charging, reduce the error and complexity of manual operation, reduce the labor cost, improve the working efficiency and save the cost for the enterprise. Moreover, the automatic refrigerant charging system has the effect of intelligent monitoring and automatic adjustment, which can monitor the relevant operation parameters of the to-be-charged air conditioner 200 in real time, and detect the problems in time and carry out refrigerant charging in the cooling mode or the heating mode, which can be well adapted to the different modes, and ensure the normal operation and high-efficiency performance of the to-be-charged air conditioner 200.

In an embodiment, the to-be-charged air conditioner 200 includes an indoor unit 210 and an outdoor unit 220. The indoor unit 210 is connected to the outdoor unit 220. The charging device 100 is connected to the outdoor unit 220. Even if the to-be-charged air conditioner 200 is in various cases such as lack of refrigerant in the installation or maintenance process, the charging device 100 can realize the automatic refrigerant charging of the to-be-charged air conditioner 200 in any modes, including a switch-on command reception, a cooling mode, or a heating mode, and it only needs to detect the control parameters of the outdoor unit 220 of the to-be-charged air conditioner 200 for the comprehensive judgement, thereby ensuring the safe, reliable and effective operation of the to-be-charged air conditioner 200.

In an embodiment, the indoor unit 210 includes an evaporator 211. The evaporator 211 includes a liquid inlet end and a liquid outlet end.

The outdoor unit 220 includes a compressor 221, a gas-liquid separator 222, a condenser 223, a four-way valve 224 and a throttling member 225.

The compressor 221 has an air discharge end and an air return end. The gas-liquid separator 222 has an inlet end and an outlet end. The condenser 223 has an input end and an output end. The four-way valve 224 has a first connection port, a second connection port, a third connection port, and a fourth connection port. A slidable control block is provided in the four-way valve 224.

The air discharge end of the compressor 221 is connected to the first connection port of the four-way valve 224, and the air return end of the compressor 221 is connected to the outlet end of the gas-liquid separator 222. The inlet end of the gas-liquid separator 222 is connected to the charging member 120 and the second connection port of the four-way valve 224, respectively. The third connection port of the four-way valve 224 is connected to the liquid outlet end of the evaporator 211. The fourth connection port of the four-way valve 224 is connected to the input end of the condenser 223. The output end of the condenser 223 is connected to the liquid inlet end of the evaporator 211 through the throttling member 225.

It is to be noted that when the to-be-charged air conditioner 200 is set to the cooling mode, the slidable control block in the four-way valve 224 slides to control the connection of the first connection port and the fourth connection port, and the connection of the second connection port and the third connection port. When the to-be-charged air conditioner 200 is set to the heating mode, the slidable control block in the four-way valve 224 slides to control the connection of the first connection port and third connection port, and the connection of the second connection port and fourth connection port.

It is further illustrated that the to-be-charged air conditioner 200 includes conventional air-conditioning components including, but not limited to, the compressor 221, the condenser 223, the four-way valve 224 and other components.

It is further illustrated that the detection member 110 includes a first pressure sensor, a second pressure sensor, a first temperature sensor, a second temperature sensor, a third temperature sensor, a fourth temperature sensor, and a fifth temperature sensor.

The first pressure sensor is configured to obtain a first refrigerant pressure HP, and the second pressure sensor is configured to obtain a second refrigerant pressure LP. The first refrigerant pressure HP is higher than the second refrigerant pressure LP.

The first temperature sensor is used to obtain a refrigerant temperature Th of the condenser.

The second temperature sensor is used to obtain an outlet temperature Tl of the condenser.

The third temperature sensor is used to obtain a return air temperature Ts of the compressor.

The fourth temperature sensor is used to obtain a discharge air temperature Td of the compressor.

The fifth temperature sensor is used to obtain an ambient temperature Ta.

It is to be noted that the detection member 110 includes, but is not limited to, the above-described sensors, which can be set according to actual needs.

In an embodiment, the charging member 120 includes a charging pipeline 121 and a charging valve 122.

A first end of the charging pipeline 121 is connected to the outdoor unit 220 of the to-be-charged air conditioner 200, and a second end of the charging pipeline 121 is connected to the refrigerant storage tank 300. The charging pipeline 121 is provided with the charging valve 122.

Specifically, the charging valve 122 is controlled by the control member 130 for realizing the control of refrigerant charging on demand, which can avoid uncontrolled charging of refrigerant into the to-be-charged air conditioner 200 or leakage outside the to-be-charged air conditioner 200.

In an embodiment, the refrigerant storage tank 300 is provided with a valve body that physically prevents refrigerant leakage, and physically prevents the refrigerant storage tank 300 from opening when the refrigerant storage tank 300 is connected to the to-be-charged air conditioner 200 via the charging pipeline 121.

(S1) The control member 130 is configured to perform steps (S11)-(S13) in response to a case that the outdoor unit 220 receives a switch-on command.

(S11) The first refrigerant pressure HP is obtained from the first pressure sensor. The first refrigerant saturation temperature Tc is obtained based on the first refrigerant pressure HP. The refrigerant temperature Th is obtained from the first temperature sensor.

(S12) When |Th−Tc|> the preset refrigerant temperature value a, the charging valve 122 opens for X seconds to charge the refrigerant; then, the charging valve 122 closes, and repeat steps (S11) to (S12).

(S13) When |Th−Tc|≤ the preset refrigerant temperature value a, the outdoor unit 220 is allowed to start.

(S2) The control member 130 is also configured to perform steps (S21)-(S27) in response to a case that the to-be-charged air conditioner 200 is set to operate in a cooling mode.

(S21) The first refrigerant pressure HP is obtained from the first pressure sensor. The second refrigerant pressure LP is obtained from the second pressure sensor. The refrigerant temperature Th is obtained from the first temperature sensor. The outlet temperature Tl of the condenser is obtained from the second temperature sensor. The return air temperature Ts of the compressor is obtained from the third temperature sensor. The discharge air temperature Td of the compressor is obtained from the fourth temperature sensor. The ambient temperature Ta is obtained from the fifth temperature sensor.

(S22) The first refrigerant saturation temperature Tc is obtained based on the first refrigerant pressure HP. The second refrigerant saturation temperature Te is obtained based on the second refrigerant pressure LP.

(S23) The suction superheat SSH of the compressor is calculated by formula (1), expressed as:

$$SSH = Ts - Te. \tag{1}$$

(S24) The subcooling degree SC of the condenser is calculated by formula (2), expressed as:

$$SC = Tc - Tl + b. \tag{2}$$

In the formula (2), b denotes a first correction value.

(S25) When the suction superheat SSH of the compressor>a first preset suction superheat value c of the compressor, and the subcooling degree SC of the condenser<a preset subcooling value d of the condenser, the refrigerant coefficient η is calculated by formula (3), expressed as:

$$\eta = SC/(Tc - Ta). \tag{3}$$

(S26) According to a first preset refrigerant coefficient value and a second preset refrigerant coefficient value, the charging valve 122 is controlled to charge the refrigerant.

(S261) When the refrigerant coefficient η is less than the first preset refrigerant coefficient value e, the charging valve 122 is controlled to open for Y1 seconds for refrigerant charging.

(S262) When the refrigerant coefficient η is less than the second preset refrigerant coefficient value f, the charging valve 122 is controlled to open for Z1 seconds for refrigerant charging. The first preset refrigerant coefficient value e is greater than the second preset refrigerant coefficient value f.

(S27) Repeat steps (S21) to (S26). When the refrigerant coefficient η does not satisfy the conditions in step (S26), the refrigerant charging in the cooling mode is completed.

(S3) The control member 130 is also configured to perform steps (S31)-(S37) in response to a case that the to-be-charged air conditioner 200 is set to operate in the heating mode.

(S31) The first refrigerant pressure HP is obtained from the first pressure sensor. The second refrigerant pressure LP is obtained from the second pressure sensor. The refrigerant temperature Th of the condenser is obtained from the first temperature sensor. The outlet temperature Tl of the condenser is obtained from the second temperature sensor. The return air temperature Ts of the compressor is obtained from the third temperature sensor. The discharge air temperature Td of the compressor is obtained from the fourth temperature sensor. The ambient temperature Ta is obtained from the fifth temperature sensor.

(S32) The first refrigerant saturation temperature Tc is obtained according to the first refrigerant pressure HP, and the second refrigerant saturation temperature Te is obtained according to the second refrigerant pressure LP. It should be noted that the refrigerant pressure is closely related the refrigerant saturation temperature. In short, the refrigerant saturation temperature at a certain pressure is certain. In other words, for any refrigerant pressure, a corresponding saturation temperature can be determined. Therefore, in the air-conditioning system, the refrigerant pressure or saturation temperature can be determined according to the desired effect, and then the conversion relation between the refrigerant pressure and the saturation temperature can be queried by the existing software.

(S33) The suction superheat SSH of the compressor is calculated also by formula (1).

(S34) The discharge superheat DSH of the compressor is calculated by formula (4), expressed as:

$$DSH = Td - Tc. \tag{4}$$

(S35) When the suction superheat SSH of the compressor>a second preset suction superheat value h of the compressor, and the discharge superheat DSH of the compressor>a preset refrigerant coefficient value i of the compressor, the subcooling degree SC of the condenser is calculated by formula (5), expressed as:

$$SC = Tc - Tl + g. \tag{5}$$

In the formula (5), g denotes the second correction value.

(S36) According to the first preset subcooling degree value and the second preset subcooling degree value of the condenser, the charging valve 122 is controlled to charge the refrigerant.

(S361) When the subcooling degree SC of the condenser is less than the first preset subcooling degree value j, the charging valve 122 is controlled to open for Y2 seconds for refrigerant charging.

(S362) When the subcooling degree SC of the condenser is less than the second preset subcooling degree value k, the charging valve 122 is controlled to open for Z2 seconds to carry out refrigerant charging. The first preset subcooling degree value j is greater than the second preset subcooling degree value k.

(S37) Repeat steps (S31) to (S36), and when the subcooling degree SC of the condenser does not satisfy the conditions in step (S36), complete the refrigerant charging in the heating mode is completed.

Figure 2:
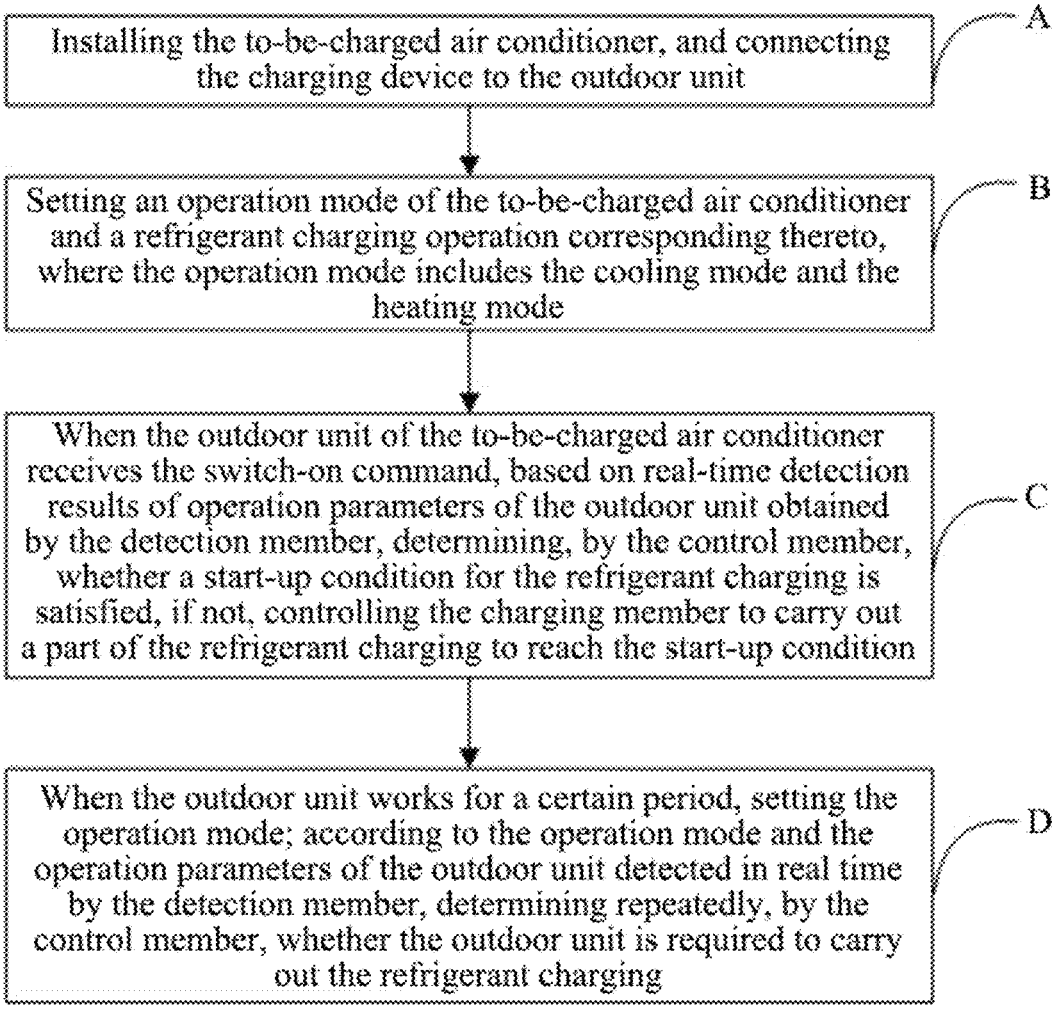
FIG. 2 is a flow chart of an automatic refrigerant charging method according to one embodiment of the present disclosure.

As shown in FIG. 2, an automatic refrigerant charging method using the automatic refrigerant charging system as described above includes the following steps.

(A) The to-be-charged air conditioner 200 is installed, and the charging device 100 is connected to the outdoor unit 220.

(B) An operation mode of the to-be-charged air conditioner 200 and a refrigerant charging operation corresponding thereto are set. The operation mode includes the cooling mode and the heating mode.

(C) When the outdoor unit 220 of the to-be-charged air conditioner 200 receives the switch-on command, based on the real-time detection results of the relevant operation parameters of the outdoor unit 220 obtained by the detection member 110, the control member 130 determines whether a start-up condition for the refrigerant charging is satisfied, if not, control the charging member 120 to carry out a part of the refrigerant charging to reach the start-up condition.

(D) When the outdoor unit 220 of the to-be-charged air conditioner 200 works for a certain period, the operation mode is set. According to the operation mode and the operation parameters of the outdoor unit 220 detected in real time by the detection member 110, the control member 130 determines repeatedly whether the outdoor unit 220 need to carry out the refrigerant charging.

Based on frequency conversion control of the to-be-charged air conditioner 200 by the outdoor unit 220, by adding the refrigerant charging control circuit and implementing the control action, the charging action and the stopping action of the automatic refrigerant charging are controlled in accordance with the detected state of the operation parameters of the to-be-charged air conditioner 200 when needed. When the air-conditioner operates to a better state, the automatic refrigerant charging is completed. Therefore, the automatic refrigerant charging method in this disclosure can greatly enhance the automatic refrigerant charging adjustment of the to-be-charged air conditioner 200 under the installation and maintenance conditions, and greatly improve the feasibility of on-site operation, lower the technical difficulty of on-site operation, and reduce the work technical workload of on-site operation.

The step of "based on the real-time detection results of the relevant operation parameters of the outdoor unit 220 obtained by the detection member 110, the control member 130 determines whether the start-up condition for the refrigerant charging is satisfied, if not, control the charging member 120 to carry out a part of the refrigerant charging to reach the start-up condition" includes the following steps (S11)-(S13).

The control member 130 is configured to perform steps (S11)-(S13) in response to a case that the outdoor unit 220 receives the switch-on command.

(S11) The first refrigerant pressure HP is obtained from the first pressure sensor. The first refrigerant saturation temperature Tc is obtained based on the first refrigerant pressure HP. The refrigerant temperature Th is obtained from the first temperature sensor.

(S12) When $|Th-Tc|>$ the preset refrigerant temperature value a, the charging valve 122 opens for X seconds to charge the refrigerant; then, the charging valve 122 closes, and repeat steps (S11) to (S12).

(S13) When $|Th-Tc|\leq$ the preset refrigerant temperature value a, the outdoor unit 220 is allowed to start.

It is further illustrated that the step of "according to the operation mode and the operation parameters of the outdoor unit 220 detected in real time by the detection member 110, the control member 130 determines repeatedly whether the outdoor unit 220 need to carry out the refrigerant charging" includes the following steps (S2)-(S3).

(S2) The control member 130 is also configured to perform steps (S21)-(S27) in response to a case that the to-be-charged air conditioner 200 is set to operate in a cooling mode.

(S21) The first refrigerant pressure HP is obtained from the first pressure sensor. The second refrigerant pressure LP is obtained from the second pressure sensor. The refrigerant temperature Th is obtained from the first temperature sensor. The outlet temperature Tl of the condenser is obtained from the second temperature sensor. The return air temperature Ts of the compressor is obtained from the third temperature sensor. The discharge air temperature Td of the compressor is obtained from the fourth temperature sensor. The ambient temperature Ta is obtained from the fifth temperature sensor.

(S22) The first refrigerant saturation temperature Tc is obtained based on the first refrigerant pressure HP. The second refrigerant saturation temperature Te is obtained based on the second refrigerant pressure LP.

(S23) The suction superheat SSH of the compressor is calculated by formula (1), expressed as:

$$SSH = Ts - Te. \tag{1}$$

(S24) The subcooling degree SC of the condenser is calculated by formula (2), expressed as:

$$SC = Tc - Tl + b. \tag{2}$$

In the formula (2), b denotes a first correction value.

(S25) When the suction superheat SSH of the compressor>a first preset suction superheat value c of the compressor, and the subcooling degree SC of the condenser<a preset subcooling value d of the condenser, the refrigerant coefficient $\eta$ is calculated by formula (3), expressed as:

$$\eta = SC/(Tc - Ta). \tag{3}$$

(S26) According to a first preset refrigerant coefficient value and a second preset refrigerant coefficient value, the charging valve 122 is controlled to charge the refrigerant.

(S261) When the refrigerant coefficient n is less than the first preset refrigerant coefficient value e, the charging valve 122 is controlled to open for Y1 seconds for refrigerant charging.

(S262) When the refrigerant coefficient η is less than the second preset refrigerant coefficient value f, the charging valve 122 is controlled to open for Z1 seconds for refrigerant charging. The first preset refrigerant coefficient value e is greater than the second preset refrigerant coefficient value f.

(S27) Repeat steps (S21) to (S26). When the refrigerant coefficient η does not satisfy the conditions in step (S26), the refrigerant charging in the cooling mode is completed.

(S3) The control member 130 is also configured to perform steps (S31)-(S37) in response to a case that the to-be-charged air conditioner 200 is set to operate in the heating mode.

(S31) The first refrigerant pressure HP is obtained from the first pressure sensor. The second refrigerant pressure LP is obtained from the second pressure sensor. The refrigerant temperature Th of the condenser is obtained from the first temperature sensor. The outlet temperature Tl of the condenser is obtained from the second temperature sensor. The return air temperature Ts of the compressor is obtained from the third temperature sensor. The discharge air temperature Td of the compressor is obtained from the fourth temperature sensor. The ambient temperature Ta is obtained from the fifth temperature sensor.

(S32) The first refrigerant saturation temperature Tc is obtained according to the first refrigerant pressure HP, and the second refrigerant saturation temperature Te is obtained according to the second refrigerant pressure LP. It should be noted that the refrigerant pressure is closely related the refrigerant saturation temperature. In short, the refrigerant saturation temperature at a certain pressure is certain. In other words, for any refrigerant pressure, a corresponding saturation temperature can be determined. Therefore, in the air-conditioning system, the refrigerant pressure or saturation temperature can be determined according to the desired effect, and then the conversion relation between the refrigerant pressure and the saturation temperature can be queried by the existing software.

(S33) The suction superheat SSH of the compressor is calculated also by formula (1).

(S34) The discharge superheat DSH of the compressor is calculated by formula (4), expressed as:

$$DSH = Td - Tc. \tag{4}$$

(S35) When the suction superheat SSH of the compressor>a second preset suction superheat value h of the compressor, and the discharge superheat DSH of the compressor>a preset refrigerant coefficient value i of the compressor, the subcooling degree SC of the condenser is calculated by formula (5), expressed as:

$$SC = Tc - Tl + g. \tag{5}$$

In the formula (5), g denotes the second correction value.

(S36) According to the first preset subcooling degree value and the second preset subcooling degree value of the condenser, the charging valve 122 is controlled to charge the refrigerant.

(S361) When the subcooling degree SC of the condenser is less than the first preset subcooling degree value j, the charging valve 122 is controlled to open for Y2 seconds for refrigerant charging.

(S362) When the subcooling degree SC of the condenser is less than the second preset subcooling degree value k, the charging valve 122 is controlled to open for Z2 seconds to carry out refrigerant charging. The first preset subcooling degree value j is greater than the second preset subcooling degree value k.

(S37) Repeat steps (S31) to (S36), and when the subcooling degree SC of the condenser does not satisfy the conditions in step (S36), complete the refrigerant charging in the heating mode is completed.

The technical solutions of the disclosure will be described in detail below in combination with the embodiments. Obviously, described above are merely illustrative, and not intended to limit the scope of the disclosure. For those skilled in the art, other embodiments obtained based on these embodiments without paying creative efforts should fall within the scope of the disclosure defined by the appended claims.

What is claimed is:

1. An automatic refrigerant charging system, comprising:

a charging device;

a to-be-charged air conditioner; and a refrigerant storage tank;

wherein the to-be-charged air conditioner is connected to the refrigerant storage tank through the charging device; the refrigerant storage tank is configured for storing a refrigerant; and the charging device is configured for controlling an amount of the refrigerant charged into the to-be-charged air conditioner;

the charging device comprises a detection member, a charging member and a control member;

the detection member and the charging member are both installed in the to-be-charged air conditioner; and the detection member and the charging member are electrically connected to the control member;

the detection member is configured for detecting operation parameters of the to-be-charged air conditioner in real time;

the charging member is configured for charging the to-be-charged air conditioner with the refrigerant;

the control member is configured for controlling a charging action of the charging member according to the operation parameters and an operating mode of the to-be-charged air conditioner;

the to-be-charged air conditioner comprises an indoor unit and an outdoor unit; the indoor unit is connected to the outdoor unit; and the charging device is connected to the outdoor unit;

the indoor unit comprises an evaporator; and the evaporator is provided with a liquid inlet end and a liquid outlet end;

the outdoor unit comprises a compressor, a gas-liquid separator, a condenser, and a four-way valve;

the compressor is provided with an air discharge end and an air return end; the gas-liquid separator is provided with an inlet end and an outlet end; the condenser is provided with an input end and an output end; and the four-way valve is provided with a first connection port, a second connection port, a third connection port and a fourth connection port;

the air discharge end of the compressor is connected to the first connection port of the four-way valve, and the air return end of the compressor is connected to the outlet end of the gas-liquid separator; the inlet end of the gas-liquid separator is connected to the charging member and the second connection port of the four-way valve, respectively; the third connection port of the four-way valve is connected to the liquid outlet end of the evaporator; the fourth connection port of the four-way valve is connected to the input end of the condenser; and the output end of the condenser is connected to the liquid inlet end of the evaporator;

the detection member comprises a first pressure sensor, a second pressure sensor, a first temperature sensor, a second temperature sensor, a third temperature sensor, a fourth temperature sensor, and a fifth temperature sensor;

the first pressure sensor is configured to obtain a first refrigerant pressure HP, and the second pressure sensor is configured to obtain a second refrigerant pressure LP; wherein the first refrigerant pressure HP is higher than the second refrigerant pressure LP;

the first temperature sensor is configured to obtain a refrigerant temperature Th of the condenser;

the second temperature sensor is configured to obtain an outlet temperature Tl of the condenser;

the third temperature sensor is configured to obtain a return air temperature Ts of the compressor;

the fourth temperature sensor is configured to obtain a discharge air temperature Td of the compressor;

the fifth temperature sensor is configured for obtain an ambient temperature Ta;

the charging member comprises a charging pipeline and a charging valve;

a first end of the charging pipeline is connected to the outdoor unit, and a second end of the charging pipeline is connected to the refrigerant storage tank; and the charging pipeline is provided with the charging valve;

the control member is configured to perform steps (S11)-(S13) in response to a case that the outdoor unit receives a switch-on command:

(S11) obtaining the first refrigerant pressure HP from the first pressure sensor; obtaining a first refrigerant saturation temperature Tc based on the first refrigerant pressure HP; and obtaining the refrigerant temperature Th of the condenser from the first temperature sensor;

(S12) when $|Th-Tc|>$ a preset refrigerant temperature value a, controlling the charging valve to open for X seconds to charge the refrigerant, and controlling the charging valve to close, and repeating steps (S11) to (S12) until $|Th-Tc|\leq$ the preset refrigerant temperature value a; and (S13) when $|Th-Tc|\leq$ the preset refrigerant temperature value a, starting the outdoor unit;

the control member is also configured to perform steps (S21)-(S27) in response to a case that the to-be-charged air conditioner is set to operate in a cooling mode:

(S21) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S22) obtaining the first refrigerant saturation temperature Tc based on the first refrigerant pressure HP; and obtaining a second refrigerant saturation temperature Te based on the second refrigerant pressure LP;

(S23) calculating a suction superheat SSH of the compressor by formula (1), expressed as:

$$SSH = Ts - Te; \tag{1}$$

(S24) calculating a subcooling degree SC of the condenser by formula (2), expressed as:

$$SC = Tc - Tl + b; \tag{2}$$

wherein b denotes a first correction value;

(S25) when the suction superheat SSH of the compressor >a first preset suction superheat value c of the compressor, and the subcooling degree SC<a preset subcooling value d of the condenser, calculating a refrigerant coefficient n by formula (3), expressed as:

$$\eta = SC/(Tc - Ta); \tag{3}$$

(S26) according to a first preset refrigerant coefficient value e and a second preset refrigerant coefficient value f, controlling the charging valve to charge the refrigerant:

(S261) when the refrigerant coefficient $\eta$ is less than the first preset refrigerant coefficient value e, controlling the charging valve to open for Y1 seconds for refrigerant charging; and (S262) when the refrigerant coefficient $\eta$ is less than the second preset refrigerant coefficient value f, controlling the charging valve to open for Z1 seconds for refrigerant charging; wherein the first preset refrigerant coefficient value e is larger than the second preset refrigerant coefficient value f, and (S27) repeating steps (S21) to (S26); and when the refrigerant coefficient $\eta$ does not satisfy conditions in step (S26), completing refrigerant charging in the cooling mode; and the control member is also configured to perform steps (S31)-(S37) in response to a case that the to-be-charged air conditioner is set to operate in a heating mode;

(S31) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S32) obtaining the first refrigerant saturation temperature Tc based on the first refrigerant pressure HP; and obtaining the second refrigerant saturation temperature Te based on the second refrigerant pressure LP;

(S33) calculating the suction superheat SSH of the compressor by the formula (1);

(S34) calculating a discharge superheat DSH of the compressor by formula (4), expressed as:

$$DSH = Td - Tc; \quad (4)$$

(S35) when the suction superheat SSH>a second preset suction superheat value h of the compressor, and the discharge superheat DSH>a preset discharge superheat value i of the compressor, calculating the subcooling degree SC of the condenser by formula (5), expressed as:

$$SC = Tc - Tl + g; \quad (5)$$

wherein g denotes a second correction value;

(S36) according to a first preset subcooling degree value j and a second preset subcooling degree value k of the condenser, controlling the charging valve to charge the refrigerant:

(S361) when the subcooling degree SC of the condenser is less than the first preset subcooling degree value j, controlling the charging valve to open for Y2 seconds for refrigerant charging; and (S362) when the subcooling degree SC of the condenser is less than the second preset subcooling degree value k, controlling the charging valve to open for Z2 seconds for refrigerant charging; wherein the first preset subcooling degree value j is greater than the second preset subcooling degree value k, and (S37) repeating steps (S31) to (S36), and when the subcooling degree SC of the condenser does not satisfy conditions in step (S36), completing the refrigerant charging in the heating mode.

2. An automatic refrigerant charging method using the automatic refrigerant charging system of claim 1, comprising:

(A) installing the to-be-charged air conditioner, and connecting the charging device to the outdoor unit;

(B) setting an operation mode of the to-be-charged air conditioner and an automatic refrigerant charging operation corresponding to the operation mode of the to-be-charged air conditioner, wherein the operation mode comprises the cooling mode and the heating mode;

(C) when the outdoor unit of the to-be-charged air conditioner receives the switch-on command, based on real-time detection results of operation parameters of the outdoor unit obtained by the detection member, determining, by the control member, whether a start-up condition for the refrigerant charging is satisfied, if not, controlling the charging member to carry out a part of the refrigerant charging to reach the start-up condition; and (D) when the outdoor unit works for a certain period, setting the operation mode; and according to the operation mode and the operation parameters of the outdoor unit detected in real time by the detection member, determining repeatedly, by the control member, whether the outdoor unit is required to carry out the refrigerant charging.

3. The automatic refrigerant charging method of claim 2, wherein step (C) comprises:

(S11) obtaining the first refrigerant pressure HP from the first pressure sensor; obtaining the first refrigerant saturation temperature Tc based on the first refrigerant pressure HP; and obtaining the refrigerant temperature Th of the condenser from the first temperature sensor;

(S12) when |Th−Tc|> the preset refrigerant temperature value a, controlling the charging valve to open for X seconds to charge the refrigerant, and controlling the charging valve to close, and repeating steps (S11) to (S12) until |Th−Tc|≤ the preset refrigerant temperature value a;

(S13) when |Th−Tc|≤ the preset refrigerant temperature value a, starting the outdoor unit.

4. The method of claim 3, wherein step (D) comprises:

the control member is also configured to perform steps (S21)-(S27) in response to the case that the to-be-charged air conditioner is set to operate in the cooling mode:

(S21) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S22) obtaining the first refrigerant saturation temperature Tc based on the first refrigerant pressure HP; and obtaining the second refrigerant saturation temperature Te based on the second refrigerant pressure LP;

(S23) calculating the suction superheat SSH of the compressor by formula (1), expressed as:

$$SSH = Ts - Te; \quad (1)$$

(S24) calculating the subcooling degree SC of the condenser by formula (2), expressed as:

$$SC = Tc - Tl + b; \quad (2)$$

wherein b denotes the first correction value;

(S25) when the suction superheat SSH of the compressor >the first preset suction superheat value c of the compressor, and the subcooling degree SC<the preset subcooling value d of the condenser, calculating the refrigerant coefficient η by formula (3), expressed as:

$$\eta = SC/(Tc - Ta); \quad (3)$$

(S26) according to the first preset refrigerant coefficient value e and the second preset refrigerant coefficient value f, controlling the charging valve to charge the refrigerant:

(S261) when the refrigerant coefficient η is less than the first preset refrigerant coefficient value e, controlling the charging valve to open for Y1 seconds for refrigerant charging; and (S262) when the refrigerant coefficient η is less than the second preset refrigerant coefficient value f, controlling the charging valve to open for Z1 seconds for refrigerant charging; wherein the first preset refrigerant coefficient value e is larger than the second preset refrigerant coefficient value f, and (S27) repeating steps (S21) to (S26); and when the refrigerant coefficient η does not satisfy conditions in step (S26), completing refrigerant charging in the cooling mode; and the control member is also configured to perform steps (S31)-(S37) in response to the case that the to-be-charged air conditioner is set to operate in the heating mode;

(S31) obtaining the first refrigerant pressure HP from the first pressure sensor; obtaining the second refrigerant pressure LP from the second pressure sensor; obtaining the refrigerant temperature Th of the condenser from the first temperature sensor; obtaining the outlet temperature Tl of the condenser from the second temperature sensor; obtaining the return air temperature Ts of the compressor from the third temperature sensor; obtaining the discharge air temperature Td of the compressor from the fourth temperature sensor; and obtaining the ambient temperature Ta from the fifth temperature sensor;

(S32) obtaining the first refrigerant saturation temperature Tc based on the first refrigerant pressure HP; and obtaining the second refrigerant saturation temperature Te based on the second refrigerant pressure LP;

(S33) calculating the suction superheat SSH of the compressor by the formula (1);

(S34) calculating the discharge superheat DSH of the compressor by formula (4), expressed as:

$$DSH = Td - Tc; \tag{4}$$

(S35) when the suction superheat SSH>the second preset suction superheat value h of the compressor, and the discharge superheat DSH>the preset discharge superheat value i of the compressor, calculating the subcooling degree SC of the condenser by formula (5), expressed as:

$$SC = Tc - Tl + g; \tag{5}$$

wherein g denotes the second correction value;

(S36) according to the first preset subcooling degree value j and the second preset subcooling degree value k of the condenser, controlling the charging valve to charge the refrigerant:

(S361) when the subcooling degree SC of the condenser is less than the first preset subcooling degree value j, controlling the charging valve to open for Y2 seconds for refrigerant charging; and (S362) when the subcooling degree SC of the condenser is less than the second preset subcooling degree value k, controlling the charging valve to open for Z2 seconds for refrigerant charging; wherein the first preset subcooling degree value j is greater than the second preset subcooling degree value k; and (S37) repeating steps (S31) to (S36), and when the subcooling degree SC of the condenser does not satisfy conditions in step (S36), completing the refrigerant charging in the heating mode.

* * * * *